US005582502A

United States Patent [19]

Herin

[11] Patent Number: 5,582,502

[45] Date of Patent: Dec. 10, 1996

[54] FORK LIFT ATTACHMENT FOR A VEHICLE

[76] Inventor: Larry L. Herin, 178 S. Division, Hesperia, Mich. 49421

[21] Appl. No.: 271,357

[22] Filed: Jul. 6, 1994

[51] Int. Cl.[6] ..... B66F 11/00

[52] U.S. Cl. ..... 414/685; 414/666; 37/405

[58] Field of Search ..... 414/685, 665–667, 414/669–671, 703, 722, 719; 37/231, 235, 236, 405

[56] References Cited

U.S. PATENT DOCUMENTS

| | | | |
|---|---|---|---|
| 2,593,796 | 4/1952 | Riewerts . | |
| 2,653,678 | 9/1953 | Lehrman . | |
| 3,272,287 | 9/1966 | Easton . | |
| 3,672,521 | 6/1972 | Bauer et al. . | |
| 3,672,525 | 6/1972 | Schaedler . | |
| 3,826,392 | 7/1974 | Farley . | |
| 3,876,090 | 4/1975 | Holland . | |
| 3,946,887 | 3/1976 | Parker | 414/729 X |
| 4,040,534 | 8/1977 | Kenworthy . | |
| 4,049,140 | 9/1977 | Roose | 414/729 X |
| 4,125,952 | 11/1978 | Jennings | 37/405 |
| 4,177,001 | 12/1979 | Blackwood . | |
| 4,222,186 | 9/1980 | Molby . | |
| 4,273,500 | 6/1981 | Yates . | |
| 4,394,107 | 7/1983 | Siebert . | |
| 4,421,449 | 12/1983 | Cotton . | |
| 4,422,819 | 12/1983 | Guest . | |
| 5,064,338 | 11/1991 | Lawrence | 414/685 |
| 5,193,296 | 3/1993 | Reilley | 37/231 |
| 5,209,002 | 5/1993 | Tranquilli et al. . | |
| 5,211,526 | 5/1993 | Robinette . | |
| 5,230,600 | 7/1993 | Marino | 414/607 |

FOREIGN PATENT DOCUMENTS

| | | | |
|---|---|---|---|
| 2040261 | 8/1980 | United Kingdom | 414/667 |

*Primary Examiner*—Donald W. Underwood
*Attorney, Agent, or Firm*—Price, Heneveld, Cooper, DeWitt & Litton

[57] ABSTRACT

A fork lift attachment is provided for attachment to a conventional snowplow lifting apparatus on the front of a vehicle, such as a pickup truck. The forklift attachment includes a frame configured to be operably mounted to the snowplow lifting apparatus for movement between a load lifted position and a load lowered position, and a pair of tines pivotally connected to the frame for movement between a raised position for storage and a lowered position for use. In one form, a tine supporting subframe is pivotally connected to the frame, and an adjustable link is connected between the subframe and the frame to limit the rotation of the tine supporting subframe so that the tines, when in the lowered use position and when lifting a heavy load, pivot forwardly to a preselected generally horizontal angle when in the load lifted position. A spring is further connected between the subframe and the frame to bias the subframe to a generally horizontal home position against the frame when the tines are not loaded.

19 Claims, 4 Drawing Sheets

FORK LIFT ATTACHMENT FOR A VEHICLE

BACKGROUND OF THE INVENTION

The present invention concerns a fork lift attachment for a vehicle, and in particular concerns a fork lift attachment configured for attachment to a conventional snowplow lifting apparatus on a vehicle, such as are often used on pickup trucks, although the present invention is not limited only to pickup trucks.

Pickup trucks and other vehicles have become an integral and necessary part of farm equipment and construction equipment. For example, a truck can carry substantial loads between remote locations relatively quickly. However, it is not always convenient to load items into or take items out of the back of a truck. Further, it is not always convenient or easy to back up a truck to a desired location since visibility can be obstructed by items in the back of the truck. Still further, backing up a truck can be difficult for individuals who do not do this on a regular basis, or for persons who are not limber enough to turn around and look rearwardly while backing up the truck.

In U.S. Pat. No. 4,421,449 to Cotton, a fork lift attachment is provided for attachment to a conventional snowplow lifting apparatus on a vehicle. The fork lift attachment includes removable tines that have a U-shaped bracket on one end for removable attachment to a frame of the fork lift attachment. However, the tines must be lifted off of the frame, and placed in a pocket for storage. As a practical matter, the tines may not always be easily removed from engagement with the frame if the U-shaped bracket becomes bent or corroded, or if foreign material builds up on the frame or on the U-shaped bracket. Further, there is a risk that the U-shaped bracket will only partially or incompletely engage the frame, thus leading to potential safety problems. An even more serious problem is inadvertent disengagement of the tine from the frame, such as when driving over a bump or pothole. Also, when the fork lift attachment of Cotton is raised to the maximum position, the tines are at such an angle that it is difficult to slide loads off of the front end of the tines.

Thus, a fork lift attachment solving the aforementioned problems is desired.

SUMMARY OF THE INVENTION

A fork lift attachment is provided for a vehicle having a conventional snowplow lifting apparatus mounted to the vehicle. The lifting apparatus includes a frame having arms configured to pivotally engage a pivot on the snowplow lifting apparatus for movement between a load lifted position and a load lowered position. A tine is pivotally secured to the frame, and is readily pivoted between a use position wherein the tine extends generally horizontally for use in a storage position. In one aspect, a tine supporting subframe is pivotally secured to the frame such that the tine supporting subframe pivots forwardly to an angled position relative to the frame when a load is lifted. This facilitates unloading materials over the from of the tines. A link is secured between the subframe and the frame to limit the forward rotation of the subframe, and further a spring is connected between the subframe and the first frame to bias the subframe to a rearwardly tilted position on the frame.

These and other features and advantages of the present invention will be further understood and appreciated by those skilled in the art by reference to the following specification, Claims and appended drawings.

DETAILED DESCRIPTION OF THE PREFERRED EMBODIMENTS

Figure 1:
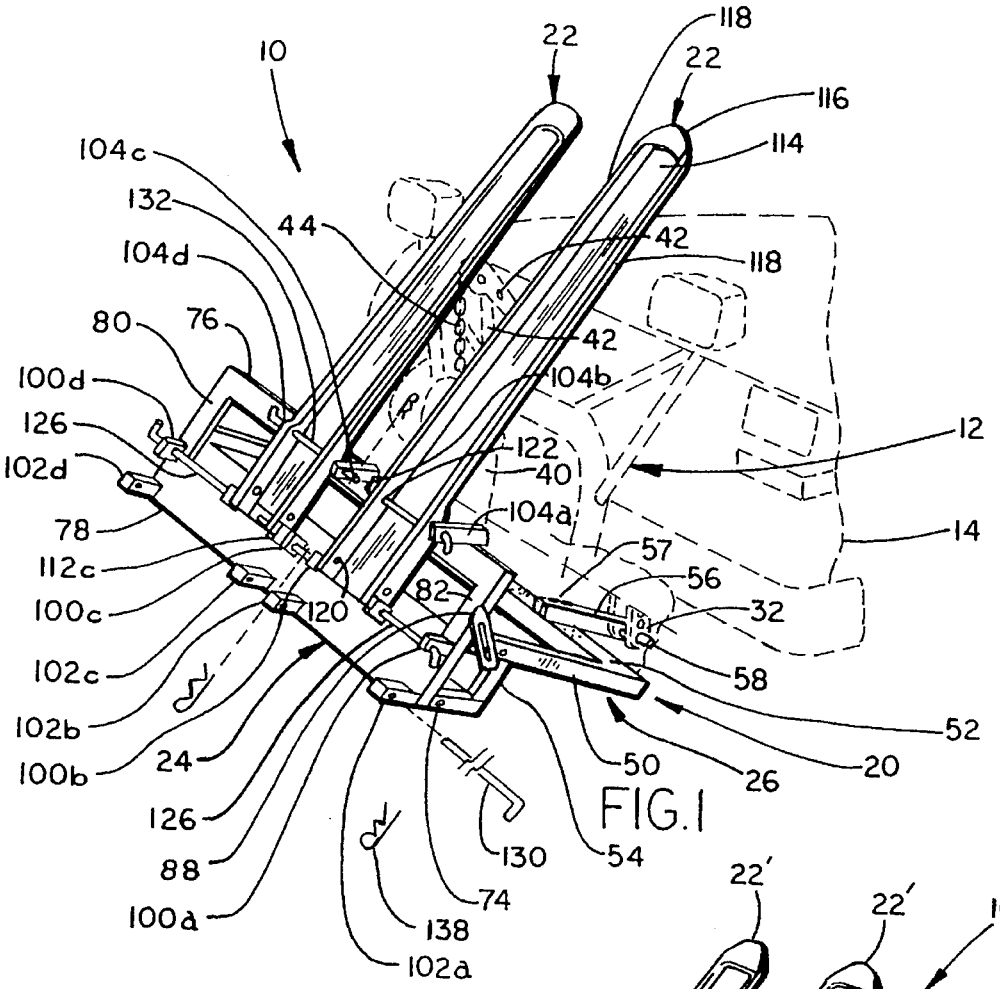
FIG. 1 is a perspective view of a fork lift attachment embodying the present invention, the tines being pivoted to a raised storage position.

For purposes of description herein, the terms "upper," "lower," "right," "left," "rear," "front," "vertical," "horizontal" and derivatives thereof shall relate to the invention as oriented in FIG. 1 with the "front" being generally toward the left of the apparatus as shown in FIG. 1. However, it is to be understood that the invention may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. For example, it is contemplated that the fork lift attachment described below can be attached to or adapted for attachment to a variety of different conventional snowplow lifting apparatus.

A fork lift attachment 10 (FIG. 1) is provided for attachment to a conventional snowplow lifting apparatus 12 on the front of a vehicle 14, such as the illustrated pickup truck. The fork lift attachment 10 includes a frame 20 configured to be pivotally mounted to the snowplow lifting apparatus 12, and a pair of tines 22 pivotally connected to the frame 20 for movement between a raised storage position and a lowered use position. Tines 22 can be conveniently pinned in either the use position (FIGS. 4–7) or storage position (FIGS. 1–3), and further can be rotationally moved between these positions without the operator having to lift the full weight of the tines 22.

Frame 20 (FIG. 1) includes a base subframe 26, and a tine supporting subframe 24 pivotally connected to the base or carrier subframe 26 at pivot pin 74. An adjustable link 88 limits the rotation of the tine supporting subframe 24 on base subframe 26 so that the tines 22, when in the use position and supporting a load, are oriented at an optimum relative angle to frame 20. (See FIG. 7.) However, a spring 30 is attached between subframe 24 and subframe 26 to bias the subframe 24 to a home position abuttingly against the subframe 26 when the tines 22 are not loaded or when the tines 22 are rested on the ground. This arrangement prevents tines 22 from digging into the ground when the tines 22 are lowered to the ground, as described hereinafter.

Figure 2:
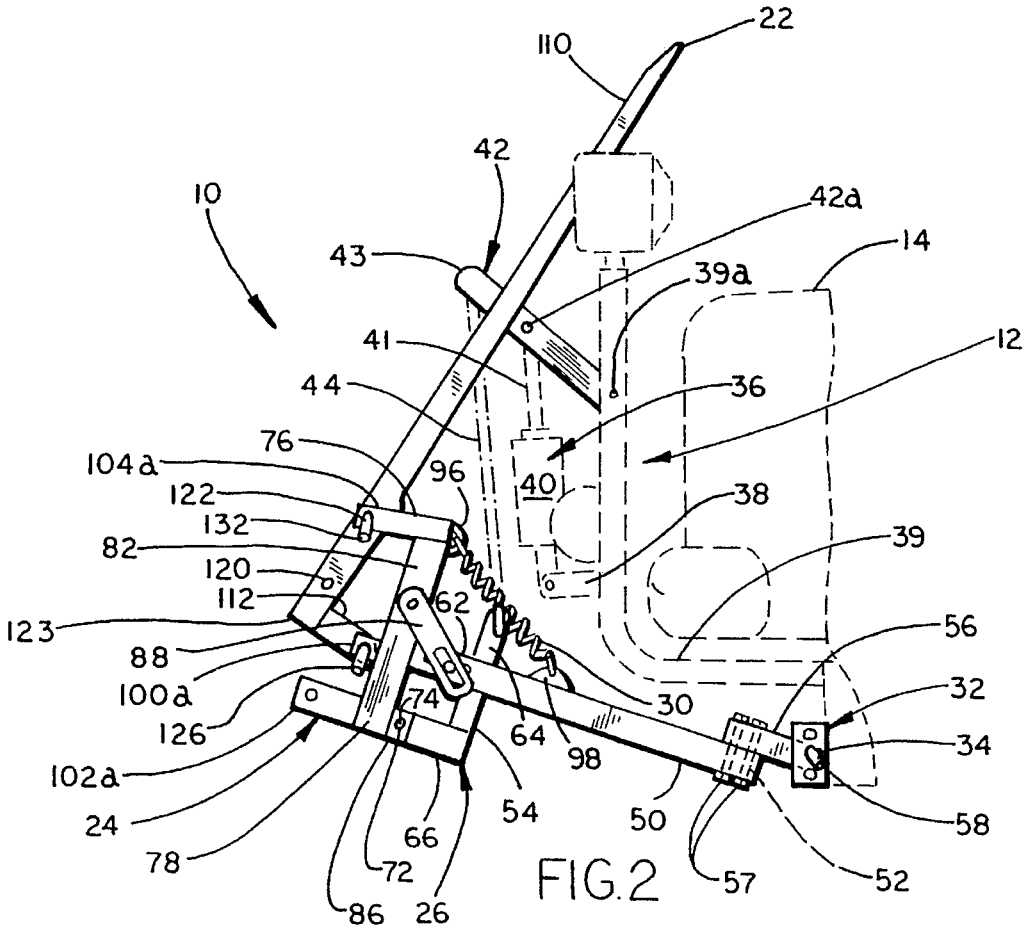
FIG. 2 is a side view of the fork lift attachment shown in FIG. 1.
Figure 3:
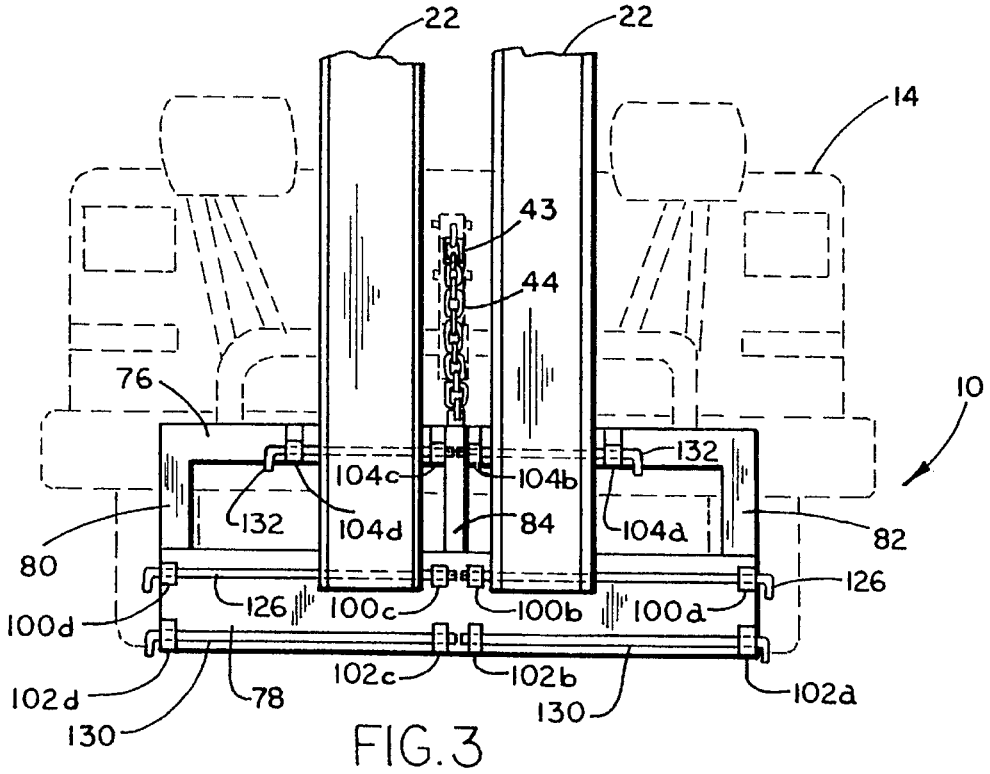
FIG. 3 is a front view of the fork lift attachment shown in FIG. 1.

The illustrated snowplow lifting apparatus 12 includes a lower pivot forming "main" mount 32 defining a pair of horizontally spaced main pivots 34 (FIG. 2). A lifting mechanism 36 is operably mounted to a platform 38 secured to the front of vehicle 14 by frame 39. Lifting mechanism 36 includes a hydraulically operated cylinder 40 supported on a platform 38, and an extendable rod 41 is operably telescopingly mounted in cylinder 40. A lift arm 42 is pivotally connected at one end to frame 39 at location 39*a* and pivotally connected at location 42*a* to rod 42. A chain 44 is attached to the "free" end of lift arm 42 at location 43. Snowplow lifting apparatus 12 is configured to pivotally support a snowplow (not shown) at lower pivot forming mount 32, and is configured to raise and lower the snowplow by operation of lifting mechanism 36.

Base subframe 26 (FIG. 2) includes a pair of horizontally spaced side arms 50 connected by first and second cross members 52 and 54 in a picture-frame-shaped arrangement. Arms 50 and cross members 52 and 54 have a C-shaped or tubular cross section for strength, and are welded together into a rigid unit. A pair of pivot engaging members 56 are secured to rear cross member 52 at locations spaced a predetermined distance apart so that member 56 will mateably engage mount 32. A pivot pin 58 pivotally secures pivoting engaging members 56 to main pivots 34 on the snowplow lifting apparatus 12. The illustrated pivot engaging members or arms 56 are secured to rear cross member 52 by bolts 57. Rear cross member 52 includes multiple holes 60 for receiving bolts 57 (FIG. 5) so that the position of pivot engaging members 56 can be adjusted on cross member 52 to mateably interface with different snowplow lifting apparatus manufactured by different companies.

Front cross member 54 (FIG. 2) is welded to the bottom of side arms 50 a few inches rearwardly from the front end 62 of side arms 50. A bracket 64 for engaging chain 44 is secured to the top and center of front cross member 54. A pair of pivot forming members 66 are secured under front cross member 54. Pivot forming members 66 each define a forwardly extending leg having a hole 72 located generally under side arm front end 62 and spaced generally vertically therefrom.

Figure 7A:
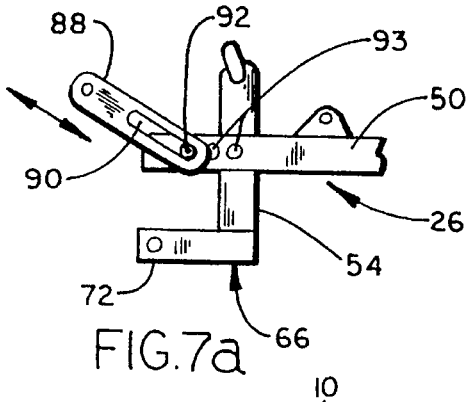
FIG. 7*a* is a fragmentary side view of a part of the frame shown in FIG. 7.
Figure 4:
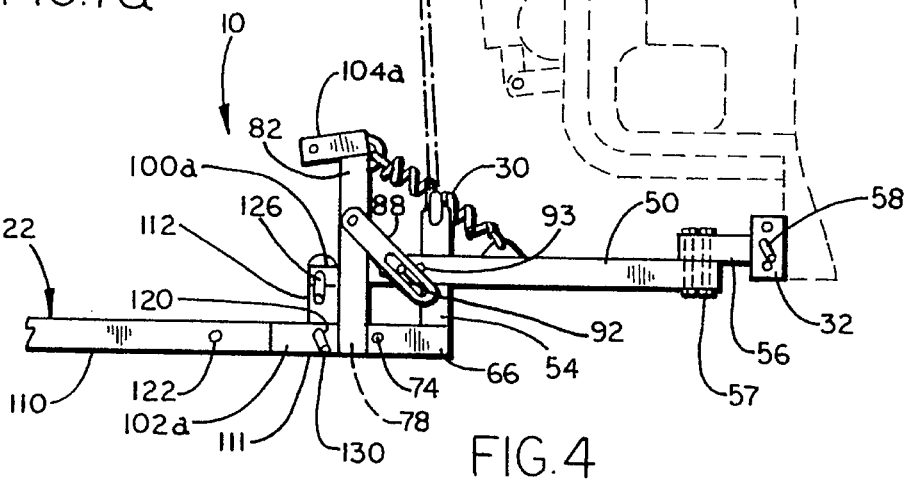
FIG. 4 is a side view of the fork lift attachment shown in FIG. 1, the tines being shown in the lowered use position.

Tine supporting subframe 24 is pivotally secured to subframe 26 by pivot pins 74. Specifically, tine supporting subframe 24 (FIG. 6) includes top and bottom cross frame members 76 and 78 rigidly interconnected by vertical end members 80 and 82 and a center brace 84. A pair of brackets 86 (FIG. 2) extend rearwardly to mateably receive pivot forming member 66. Pivot pin 74 pivotally engages a hole in bracket 86 and the hole 72 in bracket 66. Thus, tine supporting subframe 24 can be pivoted on pivot pin 74 relative to base subframe 26. A link 88 is spaced from pivot pin 74 and is pivotally secured to end member 80. Link 88 (FIG. 7*a*) includes a slot 90 for slideably engaging a laterally protruding pin 92 on side arm 50. Notably, side arm 50 includes several holes 93 so that pin 92 can be relocated to define different pivot limiting positions. Specifically, as tine supporting subframe 24 pivotally rotates forwardly in direction "A" (FIG. 7) on pivot pin 74, pin 92 engages the end of slot 90 and thus link 88 limits the forward rotation of tine supporting subframe 24. As tine supporting subframe 24 is pivotally rotated rearwardly on pivot pin 74, tine supporting subframe 24 engages the end of side arm 50 in a "home" position. A corresponding link 88 is pivotally secured between end member 82 and the other side arm 50 in an identical manner.

Springs 30 (FIG. 7) are connected to the upper cross frame member (76) at location 96 and to side arm 50 at location 98. Springs 94 bias tine supporting subframe 24 to the rearwardly pivoted position against side arm 50. This biases tines 22 toward a generally horizontal position when fork lift attachment 10 is lowered by mechanism 36 and tines 22 are rested on the ground or a floor (FIG. 4) so that the tines 22 do not tend to dig into the ground when moved to a load lowered position. When tines 22 are in a load lifted position (FIG. 7), the force of a heavy load (such as a bail of hay 28 or sheets of plywood or the like) will overcome the bias of springs 30 and tines 22 will pivot forwardly. This allows tine supporting subframe 24 to orient tines 22 so that they are positioned generally horizontally when in a raised position spaced from the ground. This makes it easier to remove load 28 over the front of tines 22. By adjusting link engaging pin 92 in any of various holes 93 (three of which are shown) in side arm 50, a desired maximum angular position or forwardly rotated position of tines 22 can be selected. By adjusting link engaging pin 92 to the "tightest" most rearwardly position, pin 92 is located substantially at the end of slot 90, and thus tine supporting subframe 24 is fixed relative to subframe 26 and cannot pivot forwardly.

Tine supporting subframe 24 (FIG. 1) includes first protrusions 100*a*–100*d* for pivotally supporting tines 22, second protrusions 102*a*–102*d* for pinning tines 22 in the use position, and third protrusions 104*a*–104*d* for pinning tines 22 in the storage position. Protrusions 100*a*–100*d*, 102*a*–102*d* and 104*a*–104*d* extend forwardly from cross members 76 and 78. The protrusions are spaced apart for receiving the rear end of tines 22, as discussed below. Protrusions 100*a*–100*b* mateably receive left tine 22 therebetween and define a tine supporting pivot for left tine 22. Similarly, protrusions 100*c*–100*d* mateably receive right tine 22 and define a tine supporting pivot for supporting right tine 22.

Tines 22 are identical and thus only the left tine 22 will be described hereinafter. Left tine 22 (FIG. 2) includes an elongated beam-like member 110 and a rear pivot forming member 112. Pivot forming member 112 of left tine 22 fits between first protrusions 100*a* and 100*b* (FIG. 1), and is pivotally mounted to protrusions 100*a* and 100*b* by tine supporting pivot pin 126. Pivot forming member 112 (FIG. 4) extends generally perpendicular to beam-like member 110 such that the rear end 111 of beam-like member 110 engages cross member 78 to hold beam-like member 110 in a generally horizontal position when pivoted to the use position. Beam-like member 110 includes a planar top web 114 (FIG. 1) having a blunted but generally pointed end 116, and side webs 118 that extend along the sides of top web 114 to rigidify top web 114. A pair of holes 120 and 122 are located in side webs 118 near the rear end of tines 22. When tine 22 is pivoted to the use position (FIG. 4), holes 120 align with corresponding holes in protrusions 102*a*–102*b*. Tine 22 is then pinned or "locked" in the use position by extending locking pins 130 through holes 120 and through the corresponding holes in protrusions 102*a*–102*b*. When left tine 22 is pivoted to the storage position (FIG. 2), holes 122 align with corresponding holes and protrusions 104*a*–104*b*. Tine 22 can then be "locked" in the use position by extending locking pins 132 through holes 122 and through the corresponding holes in the protrusions 104*a* and 104*b*. Notably, pins 130 and 132 are removable. Also, it is contemplated that a single pin (130) can be used in place of two pins (130 and 132).

Figure 7B:
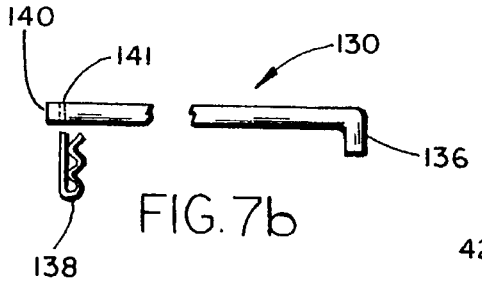
FIG. 7*b* is a fragmentary side view of a pivot pin for supporting the tines on the frame shown in FIG. 7.
Figure 7:
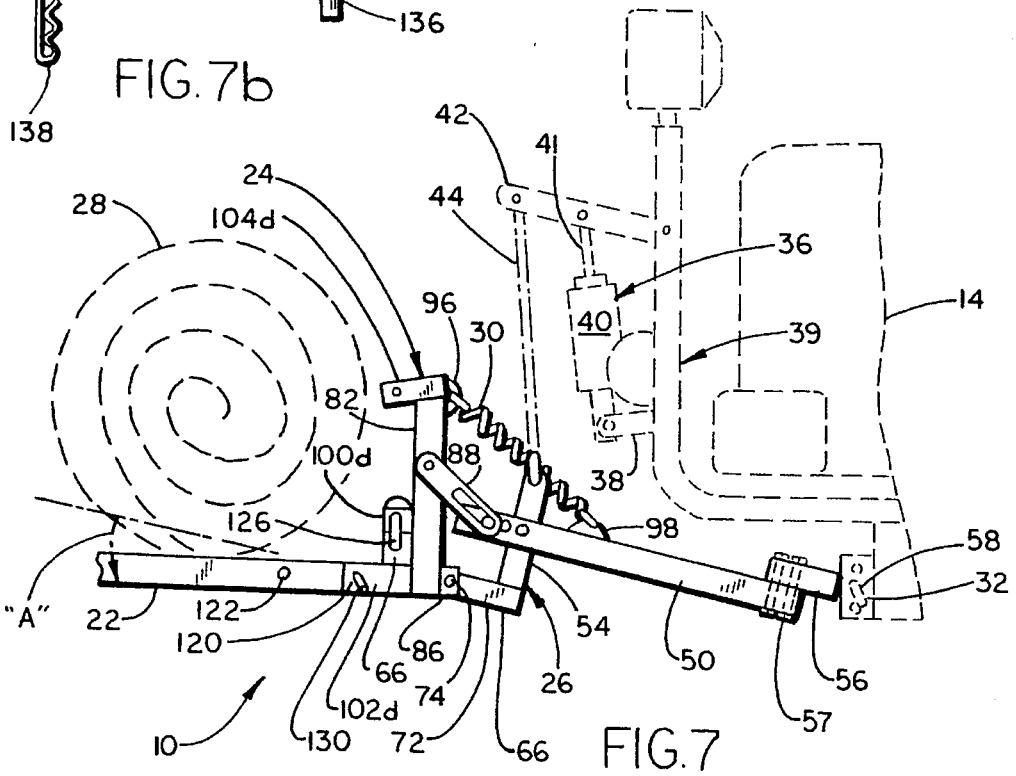
FIG. 7 is a side view of the fork lift attachment shown in FIG. 4, the fork lift attachment being shown in a use position and supporting a load with the tine supporting subframe in the forwardly tilted position.
Figure 5:
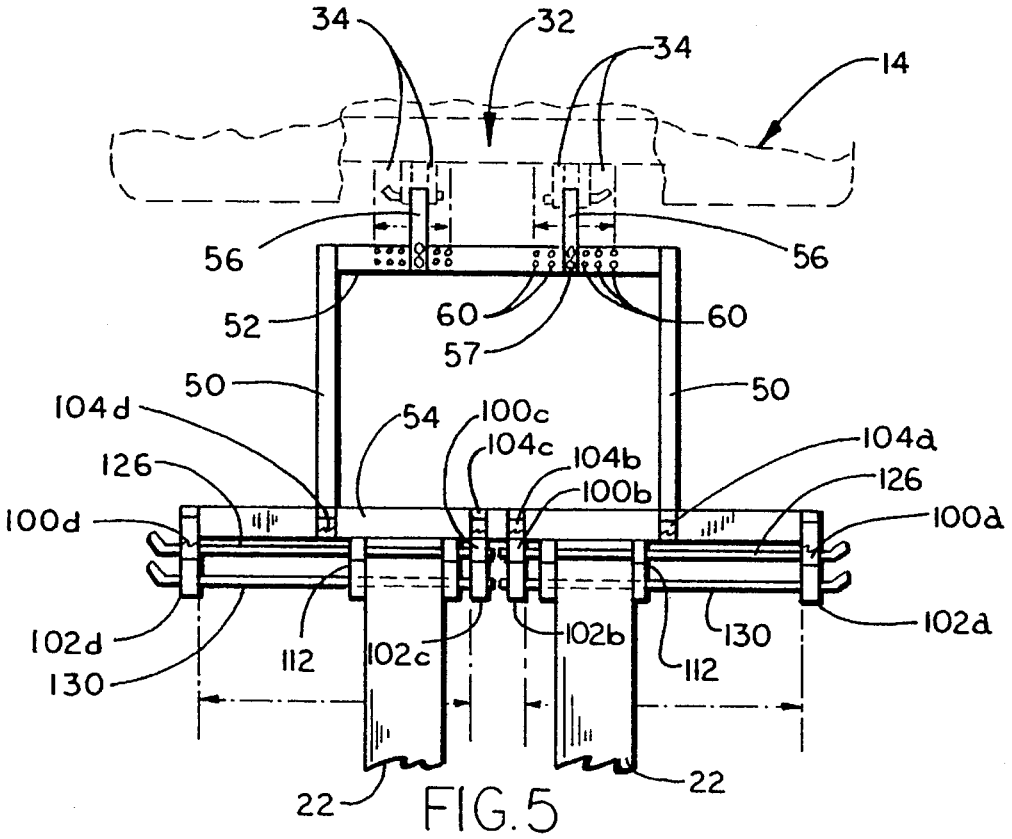
FIG. 5 is a plan view of the fork lift attachment shown in FIG. 4.
Figure 6:
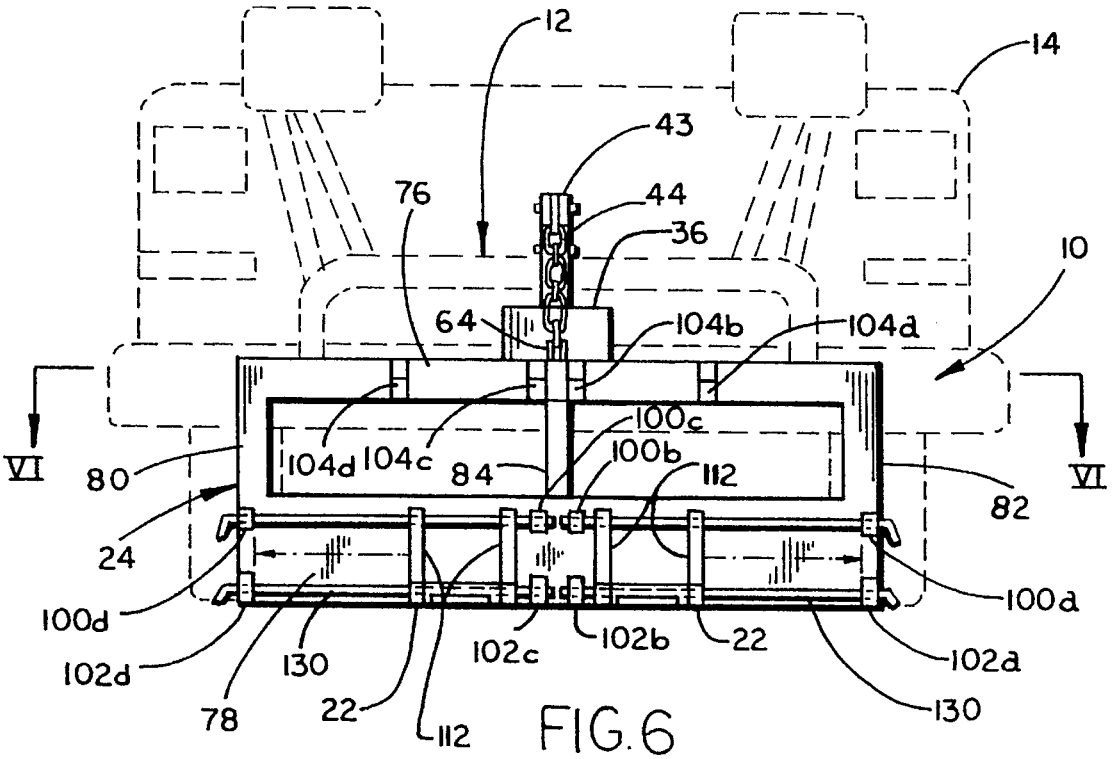
FIG. 6 is a front view of the fork lift attachment shown in FIG. 4.

The shape of pins 126 and 132 are generally identical. For example, pin 130 (FIG. 7*b*) includes a bent end 136 that acts as a handle and which also prevents pin 130 from sliding completely through holes 120. The opposite end 140 includes a hole 141 that is releasably engageable by a quick release cotter-pin-type key 138 (FIG. 1) to prevent pin 130 from sliding through holes 120 in an opposite direction. Notably, tines 22 can be lifted relatively easily by lifting on an end of tines 22 since the operator does not need to lift the full weight of the tine 22. This makes the fork lift attachment 10 easily convertible between storage and use arrangements, even if the operator is not particularly strong or has a weak back. Also, back injuries can be avoided.

In operation, fork lift attachment 10 is connected to snowplow lift attachment 12 by connecting chain 44 to the top of front cross member 54. Fork lift attachment 10 is then lifted by extending extendable rod 42 until fork lift attachment 10 is counterbalanced on chain 44. When thus counterbalanced, fork lift attachment 10 can be relatively easily manipulated to attach the pivot engaging mount 56 to the pivot forming mount 32 on the vehicle with pivot pin 34. Conveniently, tines 20 are relatively easily lifted/pivoted to a raised storage position by grasping the ends of tines 22 and lifting. In the lifted position, holes 120 in tines 22 align with corresponding holes in side webs 118 and can be pinned in the raised position by locking pin 130. This permits fork lift attachment 10 to be left on a vehicle while the vehicle is driven around. When it is desired to use tines 22, locking pin 130 is removed and tines 22 are swung carefully to a lowered use position until the rear ends 111 of tines 22 abut subframe 24.

In the lowered position, holes 122 in side webs 118 align with corresponding holes in protrusions 104*a*–104*d*. Locking pins 132 (or 130) are extended through holes 122 and corresponding holes in the side arms 50 to secure the tines in the use position. Also, adjustment pin 92 is adjusted so that link 88 limits the forward rotation of tine supporting subframe 24 to a desired maximum forward pivoted position. By properly adjusting pins 92, for example, it is possible to adjust the tines 22 when in the raised load lifted position such that sheets of plywood or bales of hay or other loads can be slid off the front of the tines without having to slide the loads up an angle defined by the tines. Also, it is noted that the tines 22 can be slid laterally along pins 126 and 130 to a predetermined distance apart to achieve a desired load stability.

Figure 8:
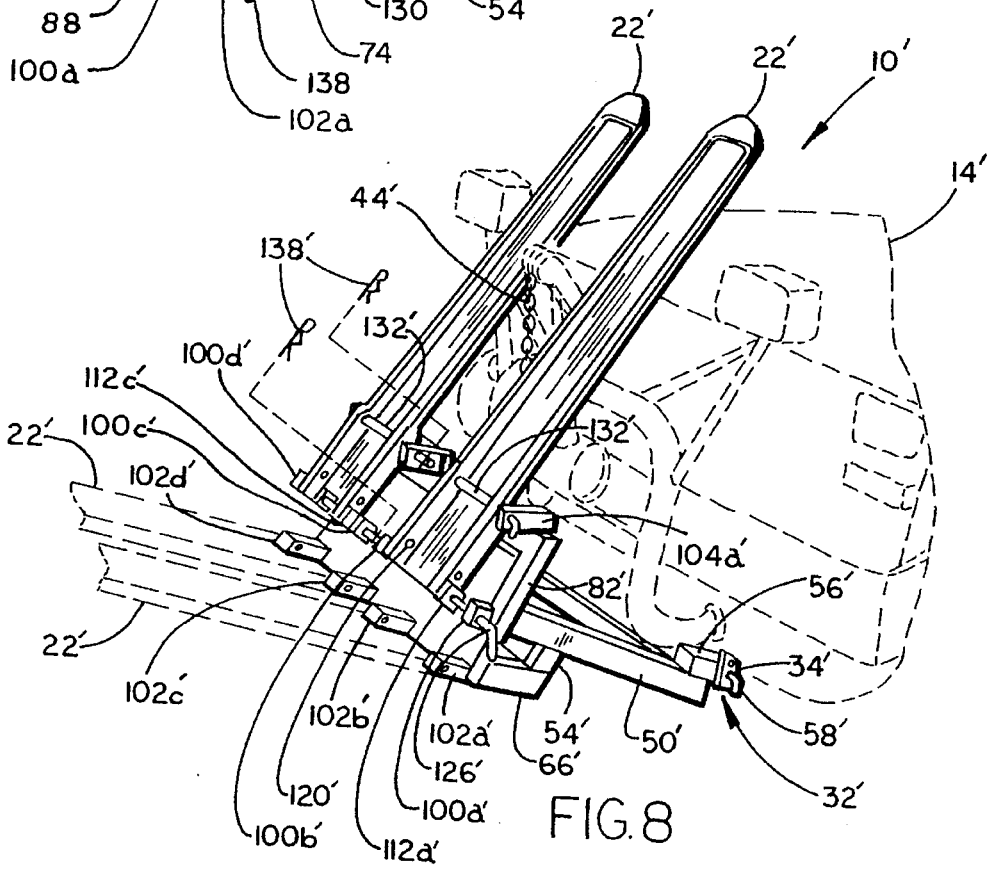
FIG. 8 is a perspective view of a modified fork lift attachment embodying the present invention.

A modified fork lift attachment 10' (FIG. 8) is similar to fork lift attachment 10 (FIG. 1), but fork lift attachment 10' does not include the forward tine tilting feature for tilting the tines when carrying a heavy load. Nor does it include the lateral adjustment feature which allows the tines to be selectively slid along pins 126 and 130 to a selected laterally spaced position. To reduce redundant discussion, comparable or identical features on fork lift attachment 10' are identified with identical numbers which are used on fork lift attachment 10, but with a prime located adjacent the numbers. Tines 22' are pivotable about pivot pins 126' between a raised storage position (FIG. 8, solid lines) and a lowered use position (FIG. 8, dashed lines), and locking pin 130' are used to lock tines 22' in either the raised storage position or the lowered use position.

Thus, a fork lift attachment is provided for convenient attachment to a snowplow lift mechanism on the front of a vehicle. The fork lift attachment includes tines which are pivotally mounted to a fork lift attachment frame for convenient movement between a lowered position for use and a raised locked position for storage while the fork lift attachment is still attached to the vehicle but not in use. In one form, the fork lift attachment includes a forward tilting feature which allows the tines to tilt forwardly when carrying a heavy load, and further includes a lateral adjustment feature which allows the tines to be selectively laterally spaced for optimal load stability.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A fork lift attachment for a vehicle having a conventional snowplow lifting apparatus mounted thereon, the lifting apparatus including a main pivot and a lift mechanism, comprising:

a frame including arms for pivotally engaging said main pivot on said conventional snowplow lifting apparatus, said frame including a bracket for operative connection to said lift mechanism for movement between a load lifted position and a load lowered position;

a tine pivotally secured to said frame so that said tine is pivotally movable between a use position wherein said tine extends generally horizontally for supporting a load, and a storage position;

a generally horizontally oriented pivot pin operably engaging said tine and said frame for pivotally mounting said tine to said frame; and said tine including an elongated beam-like member and a pivot forming member located proximate an end of said beam-like member that extends laterally from said beam-like member, said pivot pin engaging said pivot forming member in a location offset from said beam-like member so that said end of said beam-like members engages said frame when said tine is pivoted to said use position.

2. A fork lift attachment as defined in claim 1 including a second tine pivotally secured to said frame.

3. A fork lift attachment as defined in claim 2 wherein said first and second tines pivot about a common horizontal axis.

4. A fork lift attachment as defined in claim 3 wherein said first and second tines are laterally shiftable along said axis to adjust the spacing between said tines.

5. A fork lift attachment as defined in claim 1 wherein said frame includes a first subframe and a second subframe pivotally secured to said first subframe, said first subframe including said arms for engaging said main pivot and said second subframe pivotally supporting said tine.

6. A fork lift attachment as defined in claim 5 including a link operably connected between said first subframe and said second subframe to limit the rotation of said second subframe relative to said first subframe.

7. A fork lift attachment as defined in claim 6 including an adjustment member on one of said first and second subframes for adjustably engaging said link to limit said second subframe to a maximum forwardly rotated position.

8. A fork lift attachment for a vehicle having a conventional snowplow lifting apparatus mounted thereon, the lifting apparatus including a main pivot and a lift mechanism, comprising:

a frame including arms for pivotally engaging said main pivot on said conventional snowplow lifting apparatus, said frame including a bracket for operative connection to said lift mechanism for movement between a load lifted position and a load lowered position;

a tine pivotally secured to said frame so that said tine is pivotally movable between a use position wherein said tine extends generally horizontally for supporting a load, and a storage position;

said frame including a first subframe and a second subframe pivotally secured to said first subframe, said first subframe including said arms for engaging said main pivot and said second subframe pivotally supporting said tine;

a link operably connected between said first subframe and said second subframe to limit the rotation of said second subframe relative to said first subframe; and said link including a slot, and said first subframe including a slot engaging pin which slides within said slot, said slot engaging pin being configured to engage the end of said slot to limit the forward rotation of said second subframe on said first subframe.

9. A fork lift attachment as defined in claim 6 including a spring connected between said first and second subframes for biasing said second subframe rotationally rearwardly toward said first subframe into a home position.

10. A fork lift attachment as defined in claim 1 including a locking pin for locking said tine in said storage position.

11. A fork lift attachment as defined in claim 1 including a locking pin for locking said tine in said use position.

12. A fork lift attachment for a vehicle having a conventional snowplow lifting apparatus mounted thereon, the lifting apparatus including a main pivot and a lift mechanism, comprising:

a frame including arms for pivotally engaging said main pivot and a bracket for operative connection to said lift mechanism for lifting said frame;

a subframe pivotally secured to said frame;

a tine secured to said subframe; and a link secured between said frame and said subframe for limiting the rotation of said subframe relative to said frame, said link including a slot and one of the frame and subframe including a slot-engaging pin for engaging ends of the slot to limit the rotation of said subframe on the frame.

13. A fork lift attachment as defined in claim 12 including a spring connected between said frame and said subframe for biasing said sub frame toward a home position on said frame.

14. A fork lift attachment as defined in claim 13 wherein said link includes adjustment means that is adjustable to selectively preset a maximum tilted position of said subframe.

15. A fork lift attachment as defined in claim 14 wherein said tine is pivotally secured to said subframe for movement between a storage position and a use position.

16. A fork lift attachment as defined in claim 15 wherein the adjustment means includes a pin for locking said tine in the storage position.

17. A fork lift attachment as defined in claim 12 wherein said link includes adjustment means that is adjustable for selecting a maximum tilted position.

18. A fork lift attachment as defined in claim 12 wherein said tine is pivotally secured to said subframe by a pivot pin, said tine being laterally shiftable along said pivot pin.

19. A fork lift attachment as defined in claim 18 including a second tine identical to said first tine and secured to said subframe at a location spaced from said first tine.

* * * * *